US006189232B1

(12) United States Patent
Milosavljevic et al.

(10) Patent No.: US 6,189,232 B1
(45) Date of Patent: Feb. 20, 2001

(54) BLOW-SUCTION BOX OR EQUIVALENT FOR A PAPER MACHINE OR BOARD MACHINE

(75) Inventors: Nenad Milosavljevic, Turku; Pekka Saarikivi, Raisio, both of (FI)

(73) Assignee: Valmet Corporation (FI)

( * ) Notice: Under 35 U.S.C. 154(b), the term of this patent shall be extended for 0 days.

(21) Appl. No.: 09/403,378

(22) PCT Filed: Apr. 20, 1998

(86) PCT No.: PCT/FI98/00348

§ 371 Date: Oct. 20, 1999

§ 102(e) Date: Oct. 20, 1999

(87) PCT Pub. No.: WO98/48105

PCT Pub. Date: Oct. 29, 1998

(30) Foreign Application Priority Data

Apr. 21, 1997 (FI) ..... 971693

(51) Int. Cl.[7] ..... F26B 11/02; D06F 58/00

(52) U.S. Cl. ..... 34/117; 34/122; 34/123; 34/124

(58) Field of Search ..... 34/114, 115, 119, 34/120, 122, 123, 124, 117

(56) References Cited

U.S. PATENT DOCUMENTS

| | | | | |
|---|---|---|---|---|
| 4,364,185 | * 12/1982 | Dussourd et al. | ..... | 34/122 |
| 4,441,263 | 4/1984 | Vendenpää | ..... | 34/115 |
| 4,856,205 | 8/1989 | Meyer et al. | ..... | 34/117 |
| 4,899,463 | 2/1990 | Heikkilä et al. | ..... | 34/23 |
| 4,905,380 | 3/1990 | Eskelinen et al. | ..... | 34/23 |
| 5,341,579 | 8/1994 | Schiel et al. | ..... | 34/115 |
| 5,477,624 | 12/1995 | Haessner et al. | ..... | 34/117 |
| 5,509,215 | 4/1996 | Koiranen et al. | ..... | 34/117 |
| 5,515,619 | 5/1996 | Kahl et al. | ..... | 34/114 |

FOREIGN PATENT DOCUMENTS

| | | | |
|---|---|---|---|
| 3910600 | 10/1993 | (DE) | D21F/5/04 |
| 296 01 543 U | 5/1996 | (DE) | F26B/13/16 |
| 59637 | 5/1981 | (FI) | D21F/5/04 |
| 75892 | 4/1988 | (FI) | D21F/5/04 |
| 82095 | 9/1990 | (FI) | D21F/5/04 |

OTHER PUBLICATIONS

Copy of PCT International Search Report.

* cited by examiner

*Primary Examiner*—Denise L. Ferensic
*Assistant Examiner*—Andrea M. Joyce
(74) *Attorney, Agent, or Firm*—Steinberg & Raskin, P.C.

(57) ABSTRACT

The invention concerns a blow-suction box or equivalent for a paper machine or board machine, which box comprises at least a pressure chamber and which box is placed in the vicinity of a cylinder, roll, or equivalent, from which cylinder, roll or equivalent, a web and/or a wire is/are fitted to run past the box. In connection with the pressure chamber, a nozzle slot has been arranged, out of which a sealing blowing is fitted to be applied towards the cylinder, roll or equivalent and/or towards the web and/or wire running on its face in order to disintegrate the boundary-layer air flow carried along with the web and/or wire. In connection with the nozzle slot, an air guide made of a resilient material has been fitted in order to direct the sealing blowing and to enhance the sealing further.

11 Claims, 4 Drawing Sheets

BLOW-SUCTION BOX OR EQUIVALENT FOR A PAPER MACHINE OR BOARD MACHINE

FIELD OF THE INVENTION

The invention concerns a blow-suction box or equivalent for a paper machine or board machine, which box comprises at least a pressure chamber and which box is placed in the vicinity of a cylinder, roll, or equivalent, from which cylinder, roll or equivalent a web and/or a wire is/are fitted to run past the box.

BACKGROUND OF THE INVENTION

With respect to the prior art related to the present invention, reference can be made to the DE Utility Model Publication 29601543, to the DE Patent 3910600, to the U.S. Pat. Nos. 5,515,619 and 4,856,205, from which publications a mechanical seal is known which is used in connection with a blow-suction box or equivalent, which is in contact with, or in a near proximity of, a wire or equivalent, and which seals the closing nip between the box and the adjacent cylinder in order to cut off a boundary-layer air flow. A boundary-layer air flow follows a paper web and a wire when they come from a drying cylinder towards a reversing cylinder or roll. In the prior-art solutions, the seal is mechanical and often also rigid, in which case it may damage the wire coming from the cylinder, or it can be broken itself. These physical seals can be broken as a result of prolonged operation, and, moreover, owing to deterioration or damaging of a seal, the capacity of blow-suction boxes is lowered considerably in paper machines.

One problem in the prior-art blow-suction boxes has been the problems of runnability as air is pumped through the wire in a nip, which results in separation of the web from the wire and, at the same time, causes wrinkles and bag formation.

One object of the present invention is to provide a solution in which the problems mentioned above have been eliminated or at least minimized.

With respect to the prior art, reference is also made to the applicant's FI Patent No. 80,491 (equivalent to U.S. Pat. No. 4,905,380), in which a method and a dryer group in a multi-cylinder dryer in a paper machine are described, in whose connection a blow-suction box is employed which includes a suction and/or closing compartment, by whose means the upper free sectors of reversing cylinders between the adjacent wedge spaces have been covered. In the gaps between drying cylinders, said combined blow-suction boxes are placed, which have a plane wall at the inlet side of the drying wire and of the web, into whose edge a nozzle opening or openings is/are opened, by whose means a flow is blown which ejects in the direction opposite to the direction of movement of the drying wire placed facing said nozzle opening(s), by means of which flow a field of vacuum is induced in the gap space between said wall and the straight run of the drying wire and the web as well as in the following wedge space. An object of the present invention is further development of the blow-suction box so that the effects of the boundary-layer air flow are eliminated and that the effect achieved by means of the blow-suction box on the support and runnability of the paper is improved.

As is known from the prior art, multi-cylinder dryers in paper machines usually consist of two horizontal rows of drying cylinders placed one row above the other, between which the paper web runs meandering. In connection with the drying cylinders, currently, drying wires permeable to air are employed. In the dryer section of a paper machine, single-wire draw and/or twin-wire draw is/are employed. Single-wire draw is understood as a draw in which the web runs from one drying cylinder onto the other on support of one and the same drying wire also between the rows of cylinders. In twin-wire draw, in which an upper wire and a lower wire are employed, the web has free unsupported draws when it runs from one row of cylinders to the other. The present invention is suitable for use most advantageously in applications with single-wire draw.

OBJECTS AND SUMMARY OF THE INVENTION

The blow-suction box or equivalent in accordance with the present invention for a paper machine is mainly characterized in that, in connection with the pressure chamber, a nozzle slot has been arranged, out of which a sealing blowing is fitted to be applied towards the cylinder, roll or equivalent and/or towards the web and/or wire running on its face in order to disintegrate the boundary-layer air flow carried along with the web and/or the wire, and that, in connection with the nozzle slot, an air guide made of a resilient material has been fitted in order to direct the sealing blowing and to enhance the sealing further.

In accordance with the invention, the effects of the boundary-layer air flow are eliminated by cutting off the boundary-layer air flow by means of a blow-suction box or by means of an equivalent combined air-sealing blowing. The sealing blowing prevents pumping of air into the nip. In connection with the sealing-blowing nozzle, favourably a mechanical, resilient air guide has been fitted, which extends to a distance from the wire or equivalent and which, thus, yields resiliently in the event of a possible wire contact, and, at the same time, the air guide provides aid in directing of the sealing blowing. By means of sealing blowing, the gap between the blow-suction box or equivalent and the wire/cylinder or equivalent can be sealed so that the boundary-layer air flow does not cause problems of runnability or other problems.

In accordance with the invention, in the top portion of the blow suction box, a narrow nozzle has been fitted, below which an air guide has been fitted. The air guide is made of a resilient material, e.g. plastic, rubber or of a fabric, and it is not in direct contact with the wire or equivalent. The distance between the air guide and the wire or equivalent is, for example, from about 5 mm to about 10 mm. The air guide directs and supports the sealing blowing and divides the areas of the suction zone and the sealing-blowing zone in the blow-suction box and, at the same time, the air guide prevents loss of the sealing air partly by the effect of the suction effect of the suction zone.

According to a preferred additional feature of the invention, the face of the blow-suction box following after the sealing-blowing nozzle is corrugated. The corrugated face produces microturbulence in its valley areas, in which case the removal and elimination of the boundary-layer air flow are enhanced. The valley areas in the corrugated face are provided with suction openings, through which the suction effect is produced. The pressure in the box and the support of the paper can be controlled by choosing the holes that are used in the desired way.

One object of the corrugated face is to reduce the volume of the suction zone area, in which case it is possible to suck small amounts of air in order to produce a suitable vacuum and to keep the paper web in contact with the wire. By means of a corrugated face, the suction area is automatically divided into an area formed by a number of smaller zones, in which case the keeping of the paper on the wire is controlled by sucking air out of each zone. In this way the paper remains on the wire evenly. The peaks in the corrugated face do not extend up to the wire, and the distance from the top of a wave to the wire is, for example, from about 5 to about 10 mm, and, if necessary, in connection with the corrugated face, in order to guide the wire, wire guide devices are fitted in connection with said walls.

A blow-suction box in accordance with the invention also enhances the operation of a lower reversing cylinder or roll, because, for its own part, it also eliminates air flows that are detrimental to the operation of said lower cylinders or rolls.

According to a favourable additional characteristic feature of the invention, sealing blowing in accordance with the invention has been arranged at each side of the box.

According to a favourable embodiment of the invention, it is also possible to reduce the consumption of energy by applying ideas in accordance with the present invention in connection with a what is called box for a whole pocket, a box of said sort being described, for example, in said FI Patent No. 80,491 (equivalent to U.S. Pat. No. 4,905,380).

BRIEF DESCRIPTION OF THE DRAWINGS

In the following, the invention will be described in more detail with reference to the figures in the accompanying drawing, the invention being in no way supposed to be strictly confined to the details of said illustrations.

DETAILED DESCRIPTION OF THE INVENTION

Figure 1A:
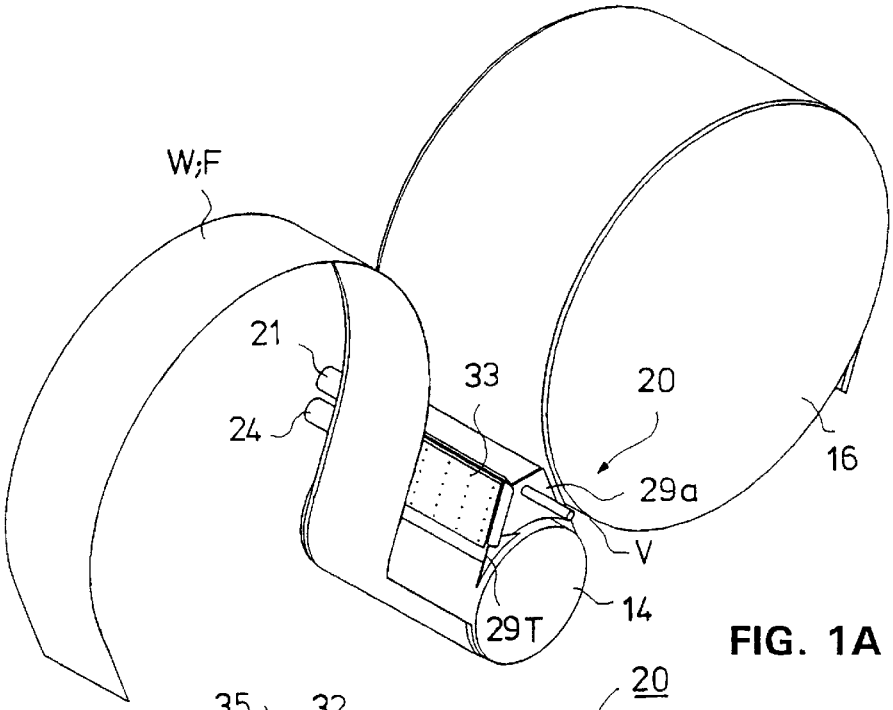
FIGS. 1A, 1B and 1C are schematic illustrations of an exemplifying embodiment of the invention.
Figure 1B:
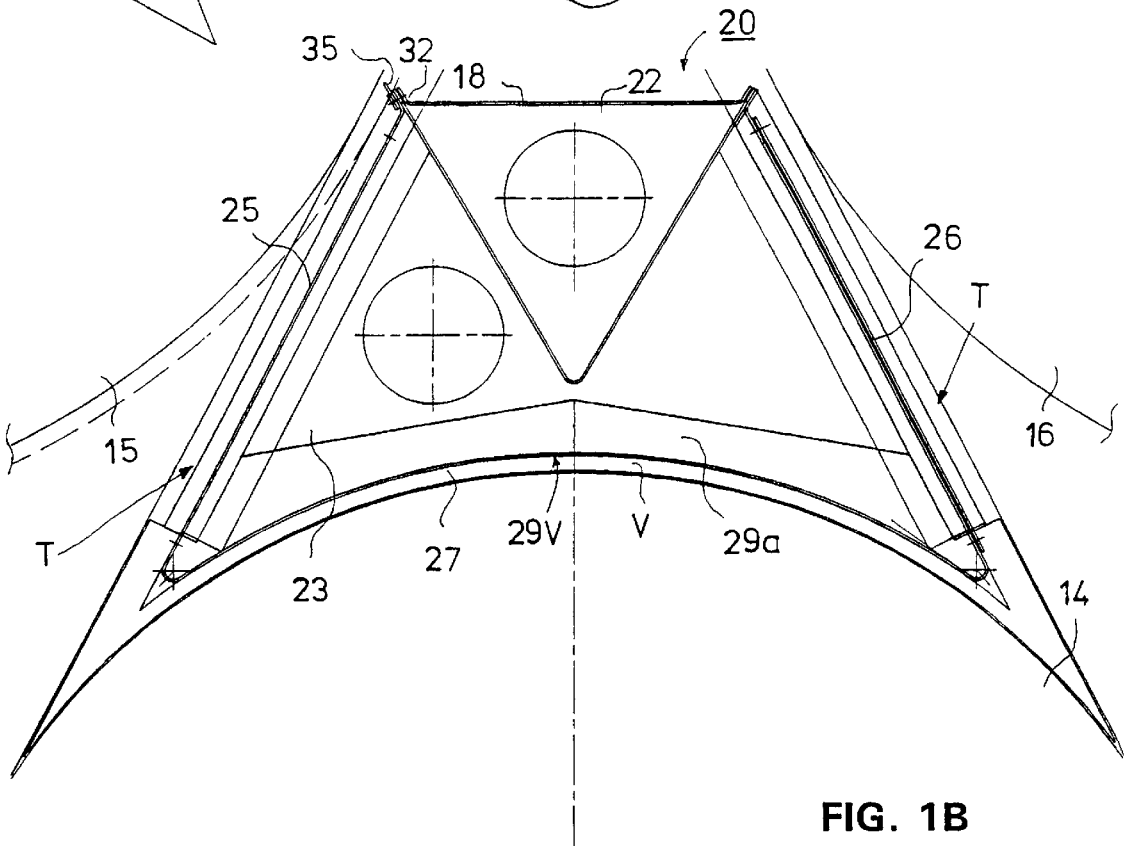
Figure 1C:
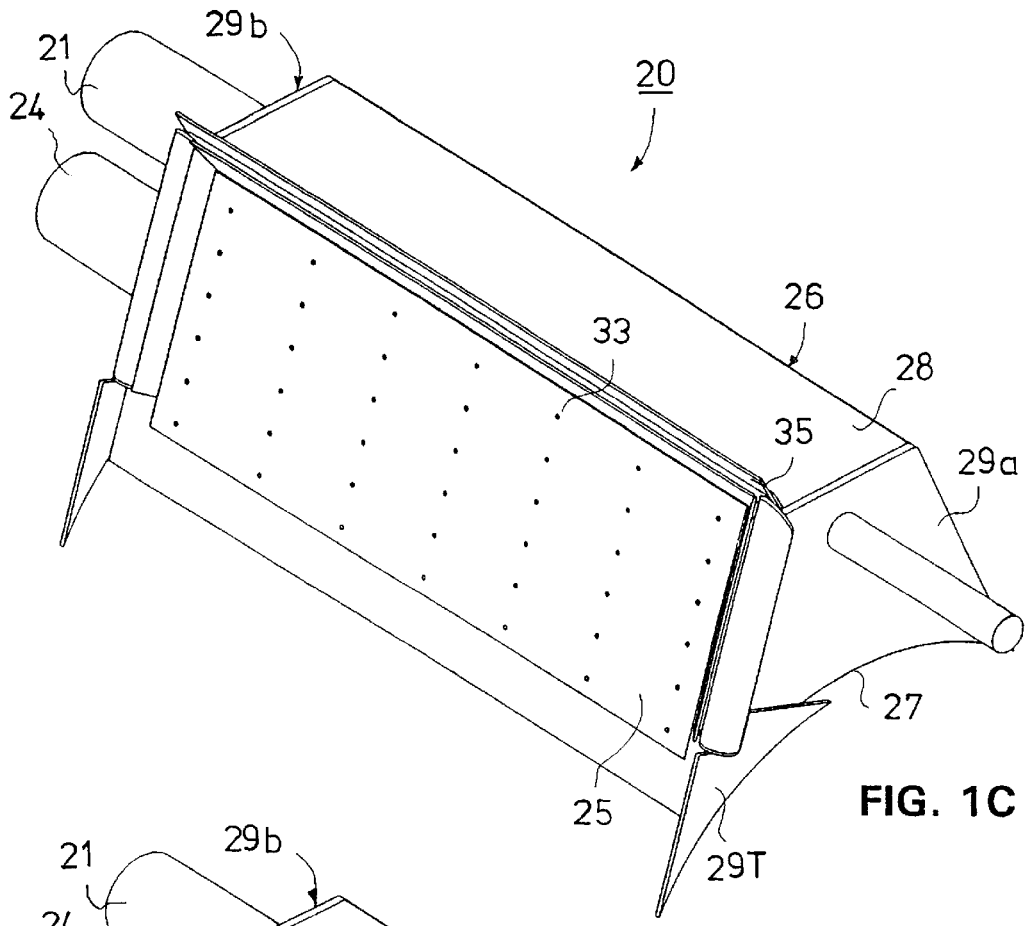

As is shown in FIGS. 1A, 1B and 1C, the blow-suction boxes 20 comprise an upper wall 28 and side walls 25 and 26 as well as a lower wall 27 and vertical end walls 29*a* and 29*b*, which end walls have curved bottom edges 29V complying with the outer face of the reversing cylinder or roll 14, which bottom edges are placed at the distance of a gap V from the mantle 18. In connection with the bottom edge 29V, there may be edge seal ribs 29T if necessary. The side walls 25 and 26 are placed at the distance of a gap T from the adjacent cylinders 15, 16, respectively, and from the web W and the wire F.

The blow-suction box 20 includes a pressure chamber 22, into which the air is passed through the duct 21. Out of the compartment 22, a sealing blowing is directed through the nozzle slot 32 of the box 20 towards the adjacent cylinder 15. The side wall 25 placed below the sealing-nozzle slot 32 is made of a perforated sheet, in which perforated sheet the holes 33 form the suction openings 33, by whose means a vacuum is produced in the intermediate space T, and in such a case a vacuum is effective in the chamber part 23, and by means of the vacuum produced through the holes 33 and effective in the space T, keeping of the web W in contact with the wire F is secured, and elimination of the boundary-layer air flow zone is enhanced partly further. Out of the vacuum chamber 23, air is removed and the vacuum is produced through the duct 24.

Below the nozzle slot 32, as the bottom wall of the nozzle, an air guide 35 has been fitted in order to direct the sealing blowing and to enhance the sealing further. The distance between the tip of the air guide 35 and the wire F/cylinder 15 is, for example, from about 5 mm to about 10 mm, and the air guide 35 is made of a resilient material, for example rubber, plastic, a fabric, or equivalent, so that, in the event of a possible wire contact, the air guide 35 bends.

Figure 2A:
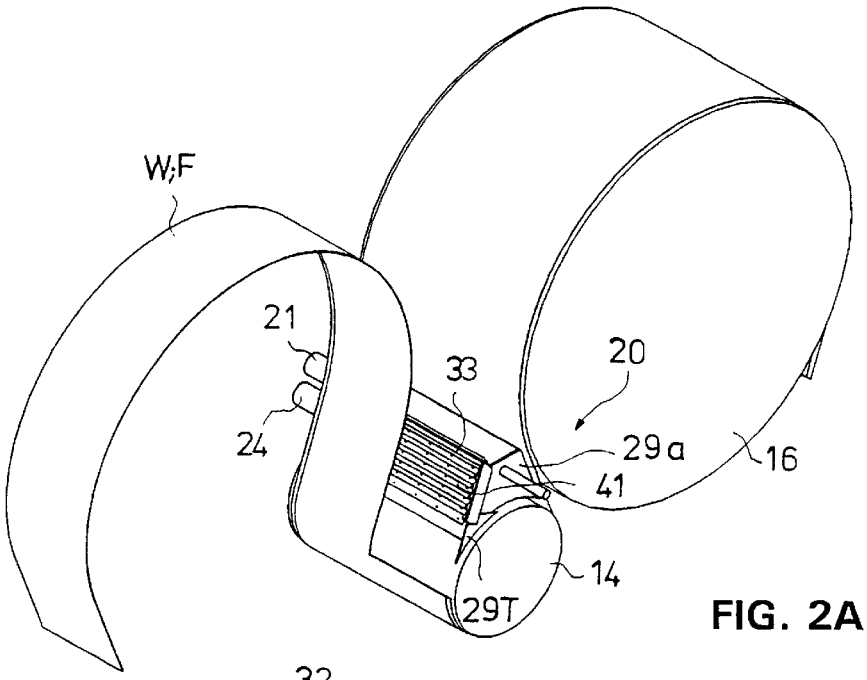
FIGS. 2A, 2B and 2C are schematic illustrations of a second exemplifying embodiment of the invention.
Figure 2B:
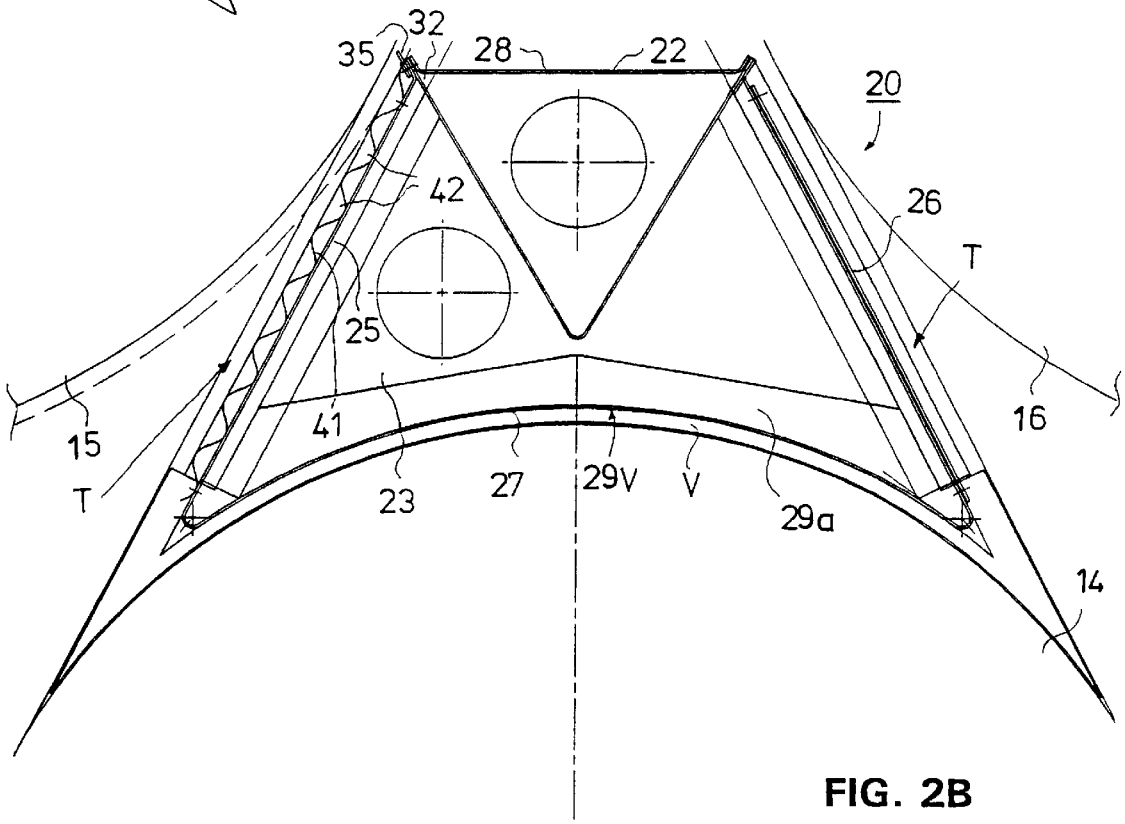
Figure 2C:
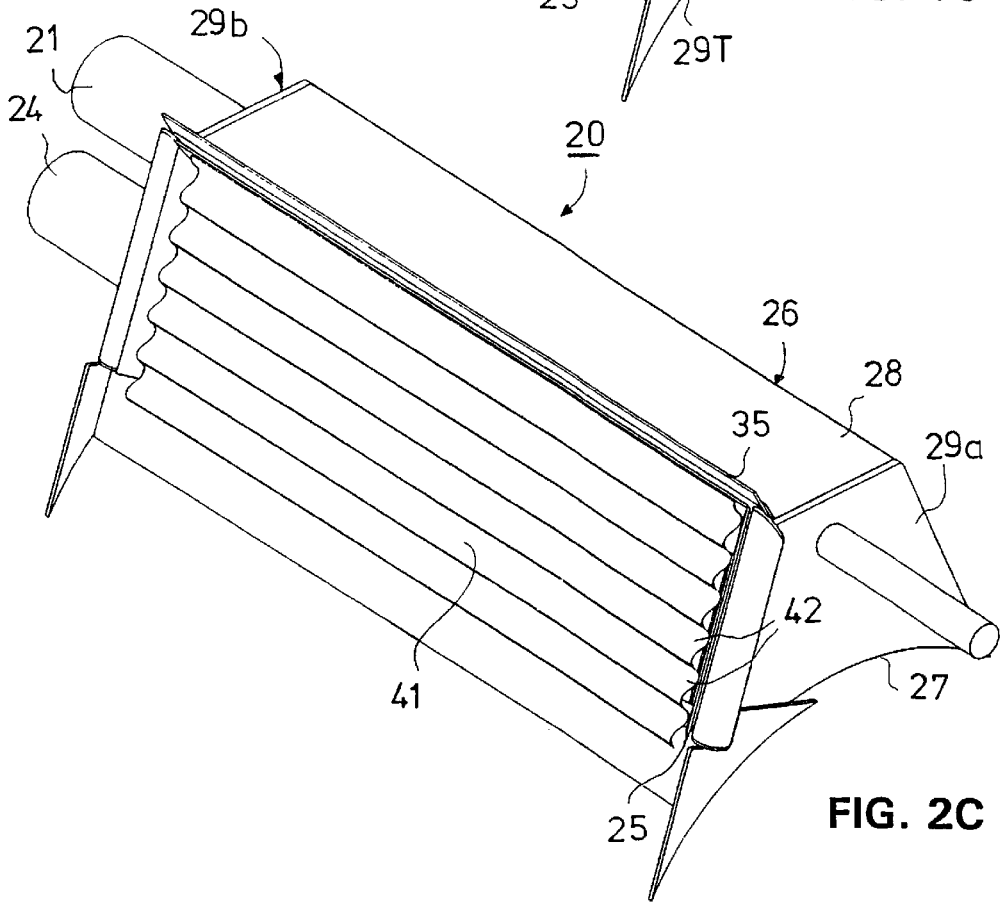

The exemplifying embodiment of the invention illustrated in FIGS. 2A, 2B and 2C is substantially similar to that illustrated in FIG. 1, and the same reference numerals represent corresponding parts. In this embodiment of the invention, the side wall 25 placed below the nozzle slot 32 for the sealing blowing at the box 20 is provided with a corrugated face 41, and the holes 33 passing into the vacuum chamber 23 are placed in the valley areas 42 in said corrugated face 41. By means of the corrugated face 41, the disintegration of the boundary-layer zone is enhanced further, and the runnability and the holding of the web W on the wire F are improved, because air vortexes are formed in the valley areas 42 of the corrugated face 41. The distance between the wave tops and the adjacent wire/cylinder is, e.g., from about 5 mm to about 10 mm.

The exemplifying embodiments of the invention shown in FIGS. 1A through 1C have been accomplished preferably with a blow-suction box that applies the principle of a what is called box for a whole pocket, which box occupies a substantial area of the pocket space between two adjacent cylinders 15, 16 and the reversing roll or cylinder 14 placed below said cylinders.

In the exemplifying embodiments shown in FIGS. 1A through 1C, between the lower wall 27 and the reversing roll 14, there can be a what is called labyrinth seal, a seal of said sort being described, e.g., in the Applicant's U.S. Pat. No. 5,509,215, or some other seal of a suitable type.

Figure 3:
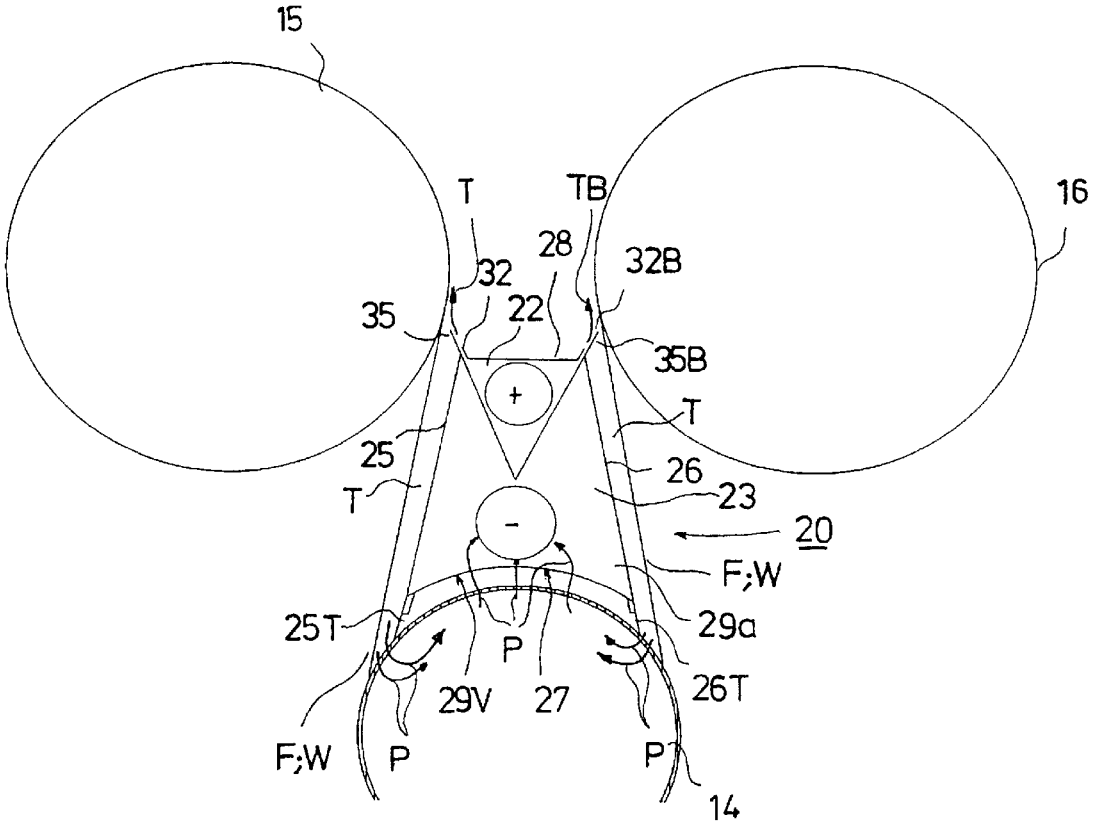
FIG. 3 is a schematic illustration of a further exemplifying embodiment of the invention.

In addition to what has been shown in FIGS. 1A through 1C, the other upper corner of the pressure compartment in the blow box may also be provided with an air-sealing nozzle slot if it is desirable to produce a nozzle flow at this side in order to guide the boundary-layer air flow, of which an exemplifying embodiment is illustrated in FIG. 3. Also in the other respects, the construction of this side can be similar to the construction of the other side, fully or partially.

The exemplifying embodiment of the invention illustrated in FIG. 3 is substantially similar to the exemplifying embodiments shown in the preceding figures, and corresponding parts are denoted with the same reference numerals. In this embodiment of the invention, sealing blowings at the box 20 have been accomplished at both sides of the box 20 so that the sealing blowing is directed from the nozzle opening 32 of the pressure compartment 22 towards the adjacent cylinder 15, and similarly from the nozzle opening 32B towards the adjacent cylinder 16. In connection with each nozzle opening 32, 32B, a mechanical air guide 35, 35B has been fitted. The arrows shown in the figure indicate the sealing blowings T, TB and the air flows P produced by the vacuum chamber 23. In the exemplifying embodiment shown in FIG. 3, seals 25T, 26T in the cross direction of the machine have also been fitted at each side in connection with the side walls 25, 26 of the box 20.

The exemplifying embodiments shown in the figures are so-called boxes for a whole pocket, but the invention is also suitable for use in connection with blow boxes or equivalent of different types.

Above, the invention has been described with reference to some preferred exemplifying embodiments of same only, the invention being, however, not supposed to be in any way strictly confined to the details of said embodiments. Many variations and modifications are possible within the scope of the inventive idea defined in the following patent claims.

What is claimed is:

1. A blow suction box for a paper machine, which box (20) comprises at least a pressure chamber (22) and which box (20) is placed in the vicinity of one of a cylinder and roll (15) from which one of the cylinder and roll (15)

one of a web (W) and a wire (F) is fitted to run past the box (20), in connection with the pressure chamber (22), a nozzle slot (32) has been arranged, out of which a sealing blowing is fitted to be applied towards one of the cylinder and roll (15) and towards one of the web (W) and wire (F) running on its face in order to disintegrate the boundary-layer air flow carried along with the one of the web (W) and the wire (F), and that, in connection with the nozzle slot (32), an air guide (35) made of a resilient material has been fitted below the nozzle and on the same side as the nozzle in order to direct the sealing blowing and to enhance the sealing further.

2. A blow-suction box as claimed in claim 1, wherein the box (20) further comprises a vacuum chamber (23), at which a side wall (25) of the vacuum chamber (23) placed at a side of the nozzle slot (32) is provided with holes (34) so as to produce a vacuum effect in a space between the box (20) and the adjacent web (W) and wire (F), in particular in a closing nip space (T).

3. A blow-suction box as claimed in claim 2, wherein, in connection with the side wall (25), a corrugated face (41) has been provided in order to further enhance a disintegration of the boundary-layer air flow.

4. A blow-suction box as claimed in claim 2 or 3, wherein a plurality of holes (33) in the side wall (25) that pass into a suction chamber (23) in the box (20) are placed in a valley area (42) of the corrugated face (41).

5. A blow-suction box as claimed in claim 1, further comprising, for sealing blowing, a second nozzle slot is provided at the opposite side of a box (20), at a side of another adjacent cylinder or roll (16).

6. A blow-suction box as claimed in claim 1, wherein the blow-suction box (20) is a blow-suction box which occupies substantially a whole of the pocket space defined by two adjacent cylinders (15, 16) and by a reversing roll (14) placed below them as interlocking with them and by one of the web (W) and the wire and which is placed at a distance of the necessary safety gaps (T, V).

7. A blow-suction box for use in one of a paper and board machine having one of a plurality of rolls and cylinders for transporting a web in said one of said paper and board machine, said blow-suction box comprising:

a box housing placed in proximity to one of said rolls and cylinders for transporting a web in said paper or board machine;

at least one pressure chamber arranged in said housing to generate an air flow out of said housing to counteract and disintegrate an air boundary layer entrained by a supporting felt which follows the felt as it comes from a drying cylinder and beads towards a reversing cylinder;

a nozzle slot for directing said air flow toward at least one of said plurality of rolls and cylinders thereby preventing the entry of the boundary layer into a space between the box and the felt; and an air guide constructed of a resilient material located below said nozzle and on the same side of the box as said nozzle, said air guide structured and arranged for directing said air flow toward said selected at least one of said plurality of rolls and cylinders.

8. A blow-suction box as claimed in claim 7, further comprising a vacuum chamber and a side wall having a plurality of holes, said side wall being structured and arranged so that said vacuum chamber generates a vacuum effect in a space between said box housing and said web.

9. A blow-suction box as claimed in claim 8, further comprising a corrugated face operably connected to said side wall.

10. A blow-suction box as claimed in claim 9, wherein said corrugated face includes a plurality of valley areas, and wherein said plurality of holes in said side wall are arranged in said valley areas.

11. A blow-suction box as claimed in claim 7, further comprising a second nozzle arranged at an opposite end of said box housing for providing a second air flow to an adjacent at least one of said plurality of rolls and cylinders.

* * * * *